US005626537A

United States Patent [19]

Danyo et al.

[11] Patent Number: 5,626,537

[45] Date of Patent: May 6, 1997

[54] EXERCISE COMPLIANCE APPARATUS AND METHOD

[76] Inventors: J. Joseph Danyo, 960 Upland Rd., York, Pa. 17403; Clark S. Hammaker, 1364 Springhouse Rd., Middletown, Pa. 17057; Todd M. Hammaker, 3 Woodlawn Ter., Hollidaysburg, Pa. 16648; Mark K. Hammaker, 154 Montgomery Ave., Phoenixville, Pa. 19460

[21] Appl. No.: 155,793

[22] Filed: Nov. 23, 1993

[51] Int. Cl.[6] ..... A61B 5/103

[52] U.S. Cl. ..... 482/8; 482/909; 601/23; 601/33; 601/34

[58] Field of Search ..... 482/1–9, 900–903, 482/909, 148, 92, 51; 601/33, 23, 27, 34, 35; 340/573

[56] References Cited

U.S. PATENT DOCUMENTS

| | | | |
|---|---|---|---|
| 4,536,755 | 8/1985 | Holzgang et al. | 340/573 |
| 4,665,899 | 5/1987 | Farris et al. | 601/33 |
| 4,801,138 | 1/1989 | Airy et al. | 601/33 X |
| 4,943,053 | 7/1990 | Smith | 601/33 X |
| 5,078,152 | 1/1992 | Bond et al. | 601/33 X |
| 5,128,655 | 7/1992 | Shore | 128/782 X |
| 5,394,888 | 3/1995 | Stone et al. | 128/782 |

FOREIGN PATENT DOCUMENTS

| | | | |
|---|---|---|---|
| 9112786 | 9/1991 | WIPO | 601/33 |

*Primary Examiner*—Richard J. Apley
*Assistant Examiner*—Glenn E. Richman
*Attorney, Agent, or Firm*—Aquilino & Welsh

[57] ABSTRACT

A device adapted to be placed upon a human for the purpose of counting exercises incident to therapeutically treating and restoring the part of the anatomy being exercised to normal use. The device accurately counts the number of repetitions the part of the anatomy is exercised in a given time period. The accuracy of the total number in a given time period is assured by anti-cheating elements which render the counting mechanism inoperable in the event the device is not on the human anatomy when the device is utilized.

12 Claims, 5 Drawing Sheets

EXERCISE COMPLIANCE APPARATUS AND METHOD

BACKGROUND OF THE INVENTION

1. Field of the Invention

The present invention relates to devices involved with the movement of joints, and in particular devices for monitoring and providing feedback.

2. Description of the Prior Art

Therapeutic devices have been developed for use with knee joints, as well as other joints of the human body. While therapeutic devices are extremely helpful in the rehabilitation of human limbs, it is often the case that the effectiveness of such devices is severely diminished because the user of the device fails to properly perform the necessary exercises. Unless a patient is under direct supervision of a physical therapist, many lack the discipline necessary to stay with a rehabilitation program.

Physical therapy can be very expensive, especially for chronic conditions which take hours of tedious repetitious exercise daily to properly rehabilitate. The exercise regimen can last for months or even years. It may be the case that it is very difficult for the patient to even go see a therapist, and too expensive to have a therapist come to see the patient personally.

In view of these difficulties, doctors often give a regimen of exercises for the patients to do at home. The patient, however, often fails to carry out the regimen. There may be a great deal of pain involved with the exercises, and as mentioned above, the exercises may be tedious and boring.

The patient may not always be entirely truthful to their doctor regarding the exercises performed, thus leaving the doctor with inaccurate data to treat his patient. Even if the patient does perform the exercises, the doctor has no way of ascertaining the character of the patient's exercise. Even worse, if there was monitoring equipment, much of today's equipment is so simple that the exercises could actually be faked and performed by other of the human limbs!

U.S. Pat. No. 5,052,375 to Stark et al. shows a microprocessor-controlled knee brace which is used for isometric exercise. That is, the brace does not pivot, but merely records the amount of stress exerted during the isometric exercise.

U.S. Pat. No. 5,052,379 to Airy et al. teaches use of a microprocessor in association with a knee brace for recording number of cycles, speed of movement and torque exerted during movement.

U.S. Pat. No. 3,939,335 to Malick discusses deactivation of a television if a device connected to the joint of a person is not properly activated.

U.S. Pat. No. 5,116,296 to Watkins et al. teaches an isometric leg rehabilitation exerciser having various sensors.

U.S. Pat. No. 4,621,620 to Anderson shows a continuous motion computer-controlled device.

Applegate and Young show hinge assemblies in cooperation with a knee brace.

SUMMARY OF THE INVENTION

It is an object of the present invention to provide an apparatus for knee exercise.

It is also an object of the present invention to provide an apparatus which assists in complying with anatomical joint exercises.

These and other objects are realized by a system and method in which a compliance device is attached to the body to monitor compliance with certain prescribed exercises. Certain apparatus is used for checking to ensure the compliance apparatus is properly attached to the human body. With the present invention, the device must be physically attached to the body in order for the counting of exercises to take place.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
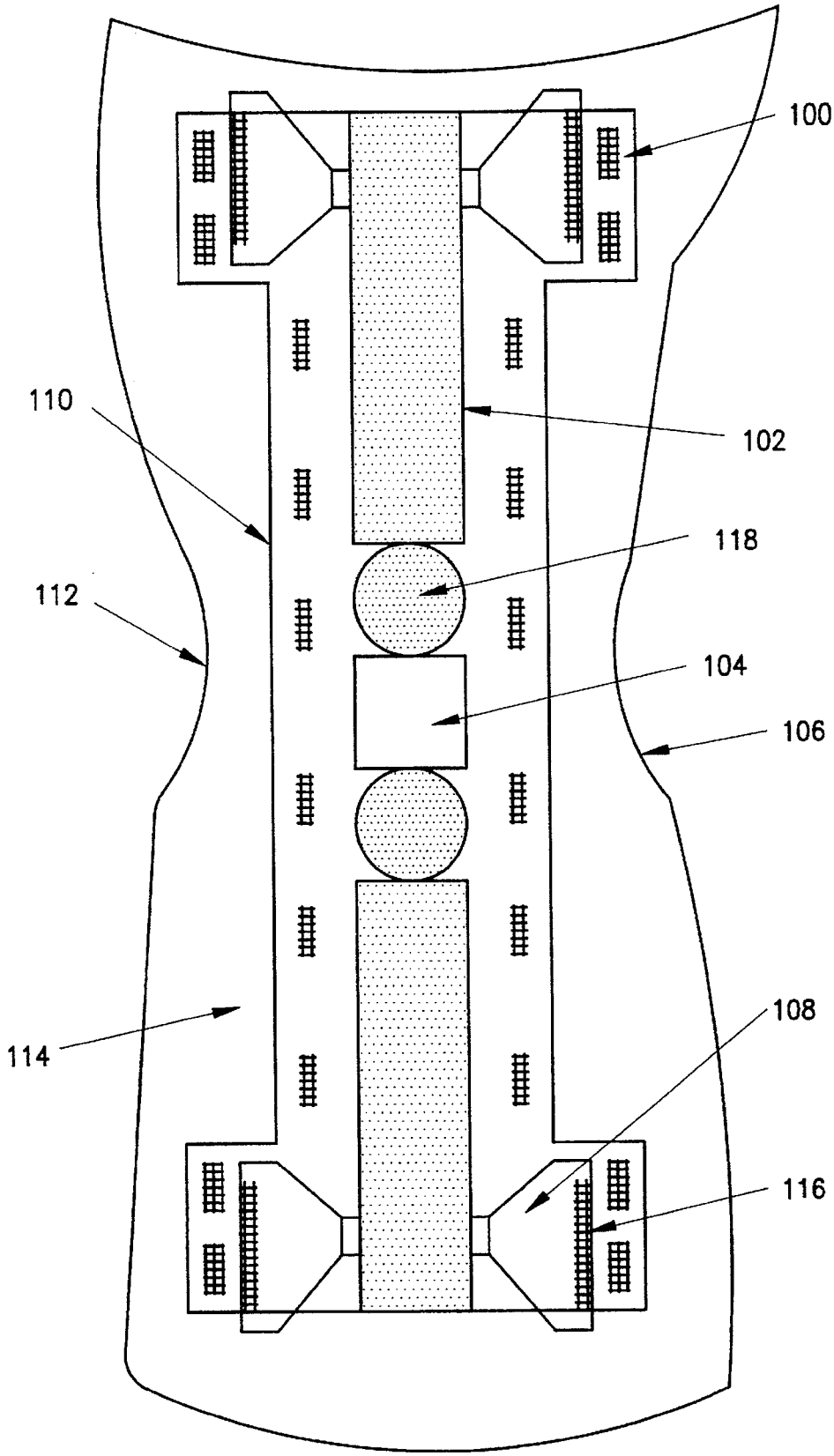
FIG. 1 is a block diagram showing the combination of knee brace, cloth cover, and mechanical parts of the compliance device.

FIG. 1 shows the compliance apparatus used in conjunction with a cloth brace 114, which holds the compliance apparatus in place. The cloth brace 114 has a cut out area 112, which allows for the joint to protrude through the cloth brace 114. A similar cut out area 106 is located on the opposite side of the cloth brace. The cut outs allow more comfortable movement of the joint during use of the compliance apparatus, and also provide greater ease of movement of the compliance apparatus.

The compliance apparatus is attached to the cloth brace 114 by cloth cover 110. It should be noted that cloth cover 110 covers the mechanical and electrical elements of the compliance apparatus. These elements have not been shown in FIG. 1 for purposes of clarity. It is also contemplated that the compliance apparatus could advantageously be attached to the brace 114 by using other configurations than cloth cover 110. The cloth cover 110 may be attached by sewing the cloth cover 110, as shown by 100, around the perimeter of the cloth cover 110.

The elements of the compliance apparatus are attached to the cloth brace 114. The apparatus could be attached in a variety of ways. For example, the apparatus could advantageously be attached via sewn areas 116. Areas 116 attach four sewable switch blocks 108 to the cloth cover 110. Flanged areas 108 could be made of a variety of materials. For example, the areas 108 could advantageously made of neoprene.

Cloth cover 110 encases brace 102 and brace pivot joint 118, which are similar or identical to the brace and brace pivot joint located on the opposing anatomical limb. Cloth cover 110 also encases flexible joint 104, which is approximately centered on the joint when the compliance apparatus and cloth brace are placed on the limb. Finally, cloth cover 110 encases the electrical circuitry (not shown), which will be discussed in further detail below.

Figure 2:
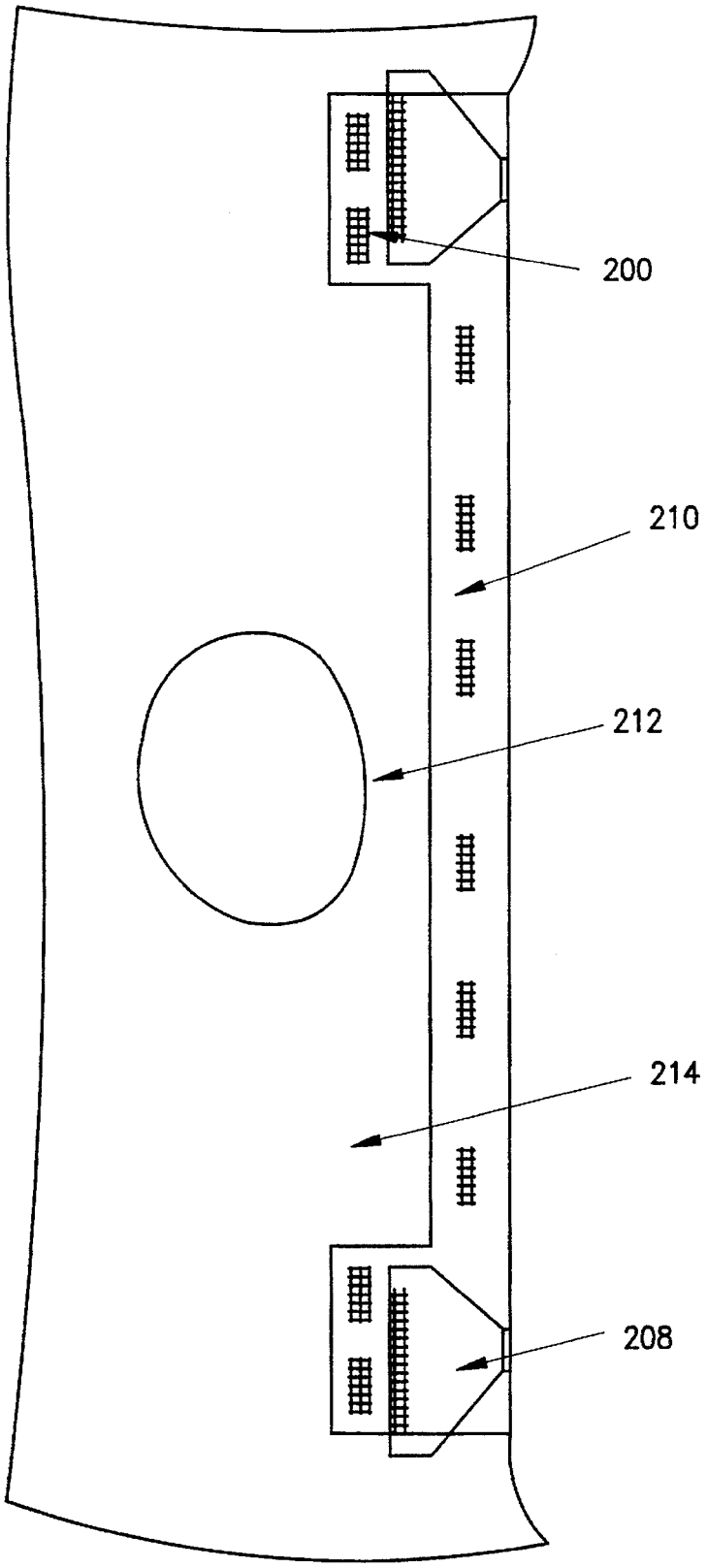
FIG. 2 is a block diagram showing a side view of the apparatus of FIG. 1.

FIG. 2 is a front view of the apparatus shown in FIG. 1. As shown in FIG. 2, 200 represents sewing patches for attaching a cloth cover over the compliance apparatus, 210 is the cloth cover, 208 is the sewable switch block, 214 is the cloth brace, and 212 is a hole for the joint while the device is being worn.

Figure 3:
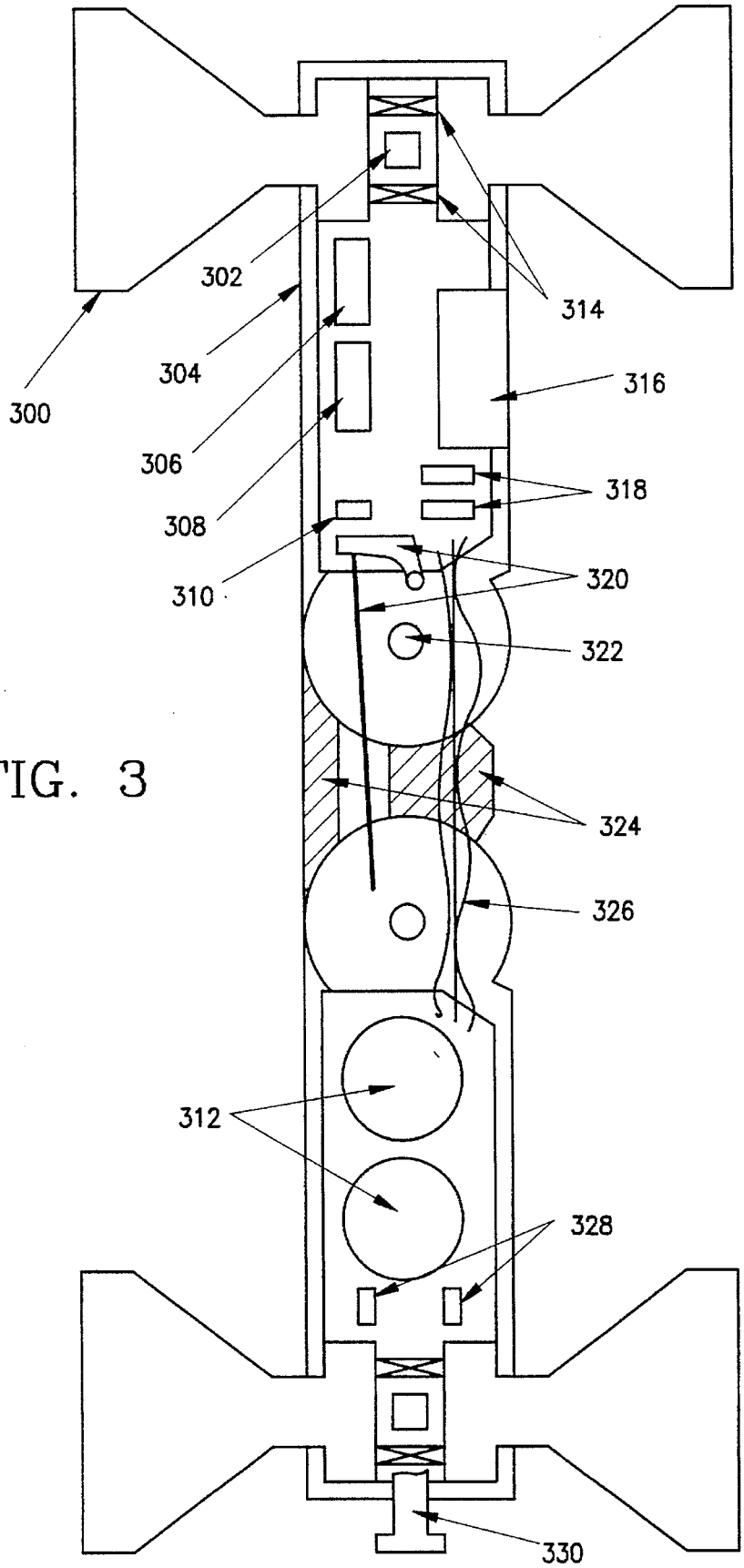
FIG. 3 is a more detailed diagram of the electrical and mechanical aspects of a preferred embodiment.

FIG. 3 shows in more detail a preferred embodiment of the present invention. Four sewable switch blocks 300 allow the device to be attached to a cloth brace for attachment to the limb. It should be noted that many elements of the compliance apparatus of FIG. 3 are mirrored on the other end of the compliance apparatus. For example, the switch assembly denoted as elements 302 and 314 also appear on the opposite end of the compliance apparatus. The discussion below will not repeat the discussion of such mirrored elements.

Cheater switch 302 and springs 314 coact to form the compliance feature of the present invention. By placing tension on the springs 314, switch 302 is activated, which must be accomplished for both switch assemblies simultaneously, allowing the electronics on the compliance apparatus to count the number of times the device is cycled.

Plastic brace cover 304 offers overall protection and concealment to the electrical and mechanical elements of the brace. The plastic brace prevents sweat and other harsh elements from damaging, or hastening the decay of the compliance device elements.

Memory 306 stores data for the compliance device, but could also be used to store program information. Memory device 306 is accessed by logic chip 308 in order to retrieve and store, and potentially, program information. It is contemplated that memory 306 could be programmed with a variety of programs to suit the particular needs of the individual using the compliance device. For example, the particular schedule of exercise, number of required repetitions, and other similar exercise data and programs could be placed in the memory device. Logic chip 308 could be a simple collection of hardwired logic, or could be a microprocessor. Logic chip 308 could be any logic capable of carrying out program execution, or simple input/output and data processing.

The logic could carry out a variety of functions, including, but not limited to, the tracking of time, counting number of times the device is being cycled, and generally accounting for any activities related to the use of the device as a compliance apparatus. Advantageously, the device could be programmed for environments other than a compliance environment. For example, the logic could be programmed with a simple exercise regimen which could be used by exercise instructors for determining overall physical activity of the user.

Counter switch 310 operates in conjunction with counter switch arm assembly 320 to count the number of times the compliance apparatus flexes. The switch may be advantageously enabled by cheater switch 302. Alternatively, cheater switch 302 could send signals to logic 308, and logic 308 could then determine whether the counts of counter switch 310 should be included in the stored data.

The particular connections among the elements are not explicitly shown in the drawings because they are well within the level of skill in the art. A simple switch such as 302 could easily be built to enable counter 310, or alternatively send a signal to logic 308.

When the compliance apparatus is placed about the joint of a user, flexing the joint will result in the counter switch arm assembly 320 activating counter 310. It is also contemplated that other assemblies for detecting flexion of the apparatus could also be used.

Elements 324 comprise a flexible joint which allows the compliance apparatus to be cycled, thus activating the counter 310 via counter switch arm assembly 320.

Batteries 312 are used to power the electrical elements of the device, and could take on a variety of configurations, depending on the particular use or needs of the device. For example, one of the batteries could be a backup battery which is used when the other is drained, being recharged, or being replaced. Alternatively, the two batteries could work together to provide the necessary ongoing power requirements of the logic 308, memory 306, and other electronics associated with the device. For example, the memory could be configured to be backed up by the battery even though the device is inactive. Associated with batteries 312 are battery actuation switches 328, which may advantageously be used to actuate batteries 312, after being enabled by battery actuation switch arm 330.

Connector 316 allows input and output between the compliance apparatus and an outside device. For example, the connector 316 could be a fifteen pin connector which is used to program memory 306, read data from memory 306, program logic 308, read data from logic 308, perform diagnostics on the compliance device, or provide real-time monitoring of the compliance device in use. It is also contemplated that the device could advantageously employ other methods of input/output, such as cellular and infrared technologies. In this manner, a local device could communicate information from and to the compliance apparatus. The local device could also communicate information to a central site. Or, communications could take place directly with a remote device.

Resistors 318 provide necessary electrical characteristics of the device, and are merely representative of the discrete support circuitry necessary for carrying out the functions of the compliance apparatus. Such circuitry could also comprise other known discrete circuitry, such as capacitors, transistors, etc.

Rivets 322 provide structural fastening necessary to attach the upper and lower structures to flexible joint 324. Wires 326 represent one or more wires which may be necessary for transferring electrical energy or signals between the upper and lower portions of the compliance apparatus. While the elements on the upper and lower halves of the apparatus are shown in a particular configuration in the preferred embodiment, it is also contemplated that the elements appearing on the upper and lower halves could be varied. For example to avoid the wires between the upper and lower halves, batteries 312 could be placed on the upper half with the logic 308 and memory 306. Alternatively, logic 308 could be on the lower half, while memory 306 is maintained on the upper half.

Wires 326 could take on another form, also. For example, the wires could be encased in a rubber or plastic material for protection from the moving elements when the device is in use. Alternatively, the wires could be embodied in a ribbon or cable of wires.

Elements 328 are battery actuation switches, and element 330 is a battery actuation switch arm. The elements combine to provide powering of the device during use and for initializing logic.

Figure 4:
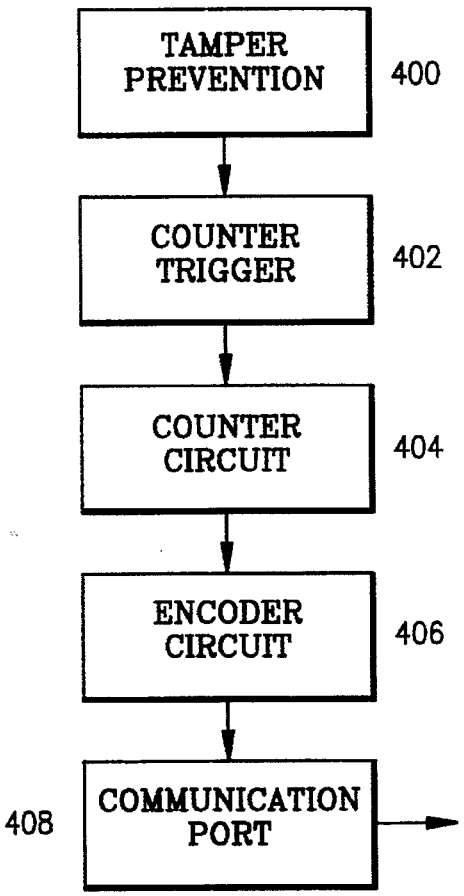
FIG. 4 is a general block diagram of some of the steps which may be performed by the device.

FIG. 4 is a functional representation of some of the steps which may be performed by the apparatus while the apparatus is in use. Tamper detection at 400 primarily includes checking the device to ensure that it is properly attached to the person. This is done through springs 314, and switch 302, as discussed with respect to FIG. 3. Tamper Prevention 400 may also include other diagnostics of the device, such as checking the integrity of the memory and other circuitry on the device.

If the apparatus is properly attached to the body, and working properly, the counter 310 is enabled to begin counting at 402. At 404, the counter circuit begins operating to count the number of times the device flexes beyond a certain point. This information is encoded, as indicated by 406, and stored in memory 306, and/or transmitted via communications connector 316, as represented by 408. The data could be processed periodically by logic 308, in order to provide meaningful information to the person reviewing the compliance record of the individual using the compliance apparatus. For example, the counter could be sampled periodically to provide rates of exercise.

Figure 5:
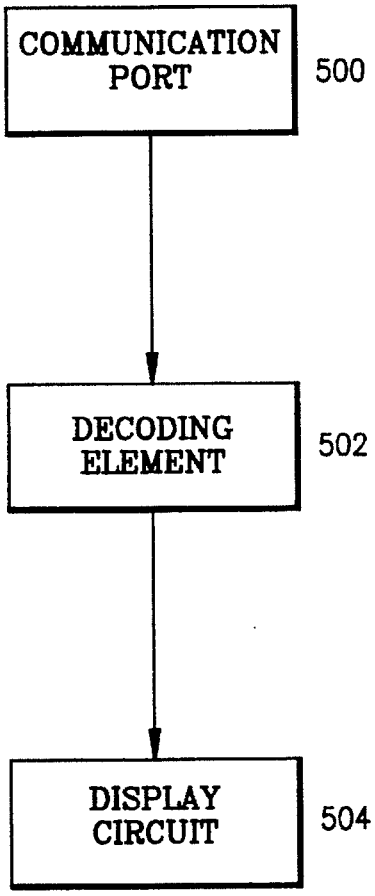
FIG. 5 is a general block diagram of some aspects of a desk unit which could be used with the present invention.

FIG. 5 is a functional diagram of certain functions and apparatus which comprise a local desk unit. 500 represents the desk unit communicating with the compliance apparatus discussed above. The information from the communication port is decoded at 502, and the data is displayed for use by either the user of the compliance apparatus or technician. The decoding element may advantageously be a processor and memory, which is capable of logging data from one or more compliance sessions, and keep track of the timing of the exercise. The time of day, date, length of exercise session, number of reps, number and length of pauses, and virtually any other data associated with such a session could be stored and processed into meaningful information. This information can then be selectively displayed at 504.

FIG. 5 is merely a characterization of the most basic elements of the desktop system. It is contemplated that a personal computer could be used for performing the functions described as associated with the compliance device of the present invention. The personal computer could be loaded with software from either a remote or local source, and could communicate with the compliance apparatus for purposes of exchanging programs and data.

Figure 6:
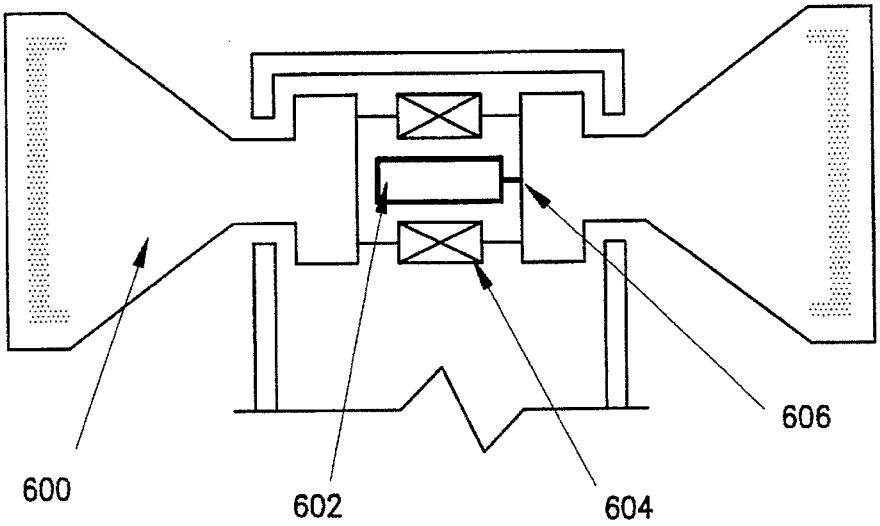
FIG. 6 shows a portion of the compliance device when it is not in place on the human body.
Figure 7:
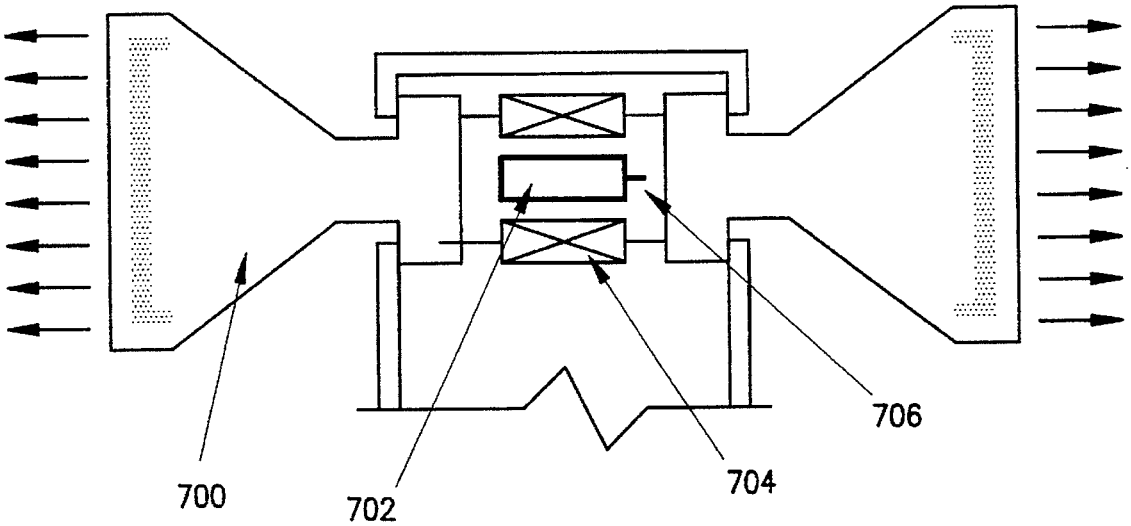
FIG. 7 shows the portion of the compliance device as shown in FIG. 6, as it appears when in place on the human body.

FIGS. 6 and 7 show in more detail the spring and switch device as shown in FIG. 3. Several of the elements are the same as those shown in FIG. 3, and therefore the description of these elements will not be repeated here. FIG. 6 shows the position of the elements when the brace is not attached to a limb, while FIG. 7 shows how the elements are positioned when the brace is in place on a limb.

With respect to FIG. 6, note the position of the sewable switch blocks 600. Because there is no tension pulling the switch blocks apart, the cheater switch 602 is being pressed upon by one of the switch blocks as shown at 606. The inward pull upon the switch blocks 600 is created by the springs 604. The pressure on the switch at 606 disables the device so that the device cannot be activated to count cycling of the brace. The device would not register any counts in response to a person cycling the device by hand.

In FIG. 7, on the other hand, the device is being worn and there is a resulting outward tension on the switch blocks 700. The switch blocks are attached to the brace, and when the brace is placed on a limb, the switch blocks are pulled apart, as indicated by the position of the switch blocks 700 in comparison to FIG. 6, and also as indicated by the tension arrows going in an outward direction away from switch blocks 700. Because the switch blocks 700 have been pulled apart, the switch 702 no longer has any pressure against it, thus enabling the device, as indicated by 706. The springs 704 are now stretched, also. The device detects that the switch is open, and in response to the open switch begins counting. Again, these action must occur simultaneously for both sets of spring and switch assemblies.

While the device is shown as detecting what is essentially a condition of tension on switch blocks 300, it is also contemplated that the condition detected could be compression. That is, the device is placed on the body in such a manner that a compression is created on the device, thus activating the counting and processing apparatus on the device.

Figure 8:
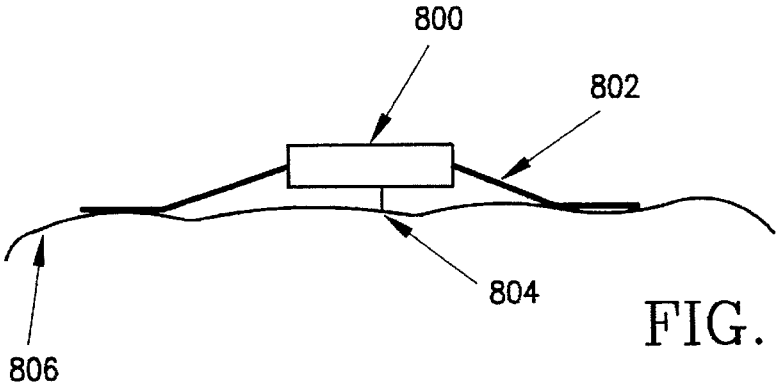
FIG. 8 shows the portion of the compliance device similar to that shown in FIGS. 6 and 7, using a compression detection device.

FIG. 8 shows a similar brace to the one demonstrated in the Figures above, except that the spring/switch combination is replaced by a compression detection device. FIG. 8 is cross-section view looking down at the compression detection device. Switch blocks 802 are still attached to brace 806 as before, but in this instance switch 800 is activated by element 804 by compression on 804 resulting from placement of the device on the anatomy.

While the above description and associated drawings have been primarily directed to an anatomical joint exercise compliance apparatus, it is contemplated that the principles demonstrated herein could be applied as well to other compliance devices. The combination of placement detection and enabling circuitry could be applied to virtually any exercise equipment which is attached in some manner to the human anatomy.

We claim:

1. A compliance apparatus for use with a device which monitors a particular aspect associated with an anatomy comprising:

at least one electromechanical switch assembly for detecting a condition, other than said particular aspect, indicating that said apparatus is placed on said anatomy, wherein said switch assembly must be actuated before the compliance apparatus will function; and, at least one monitoring element for monitoring said particular aspect associated with said anatomy only when said switching assembly for detecting a condition detects a condition indicating that said apparatus is placed on said anatomy.

2. The compliance apparatus of claim 1, wherein said switching assembly comprises:

means for detecting placement of the apparatus on a limb of said anatomy.

3. The compliance apparatus of claim 1, wherein said switching assembly comprises:

means for detecting tension.

4. The compliance apparatus of claim 1, wherein said switching assembly comprises:

means for detecting compression.

5. The compliance apparatus of claim 1, wherein said monitoring element comprises:

means for monitoring movement.

6. The compliance apparatus of claim 1, wherein said monitoring element comprises:

means for monitoring flexion.

7. The compliance apparatus of claim 1, wherein said monitoring element comprises:

means for processing.

8. The compliance apparatus of claim 1, wherein said monitoring element comprises:

means for counting.

9. The compliance apparatus of claim 1, wherein said monitoring element comprises:

means for storing information related to said means for monitoring.

10. The compliance apparatus of claim 1, further comprising:

means for communicating information with another device.

11. The compliance apparatus of claim 1, further comprising:

means for powering said apparatus via battery.

12. The compliance apparatus of claim 1, further comprising:

means for attaching said compliance apparatus to means for being placed on said anatomy.

* * * * *